US006769558B1

(12) United States Patent
Bucholtz

(10) Patent No.: US 6,769,558 B1
(45) Date of Patent: Aug. 3, 2004

(54) LEAKPROOF, RESEALABLE CONTAINER AND CAP ASSEMBLY

(75) Inventor: Michael Bucholtz, Balston Span, NY (US)

(73) Assignee: CSP Technologies, Inc., Amsterdam, NY (US)

( * ) Notice: Subject to any disclaimer, the term of this patent is extended or adjusted under 35 U.S.C. 154(b) by 0 days.

(21) Appl. No.: 09/386,702

(22) Filed: Aug. 31, 1999

(51) Int. Cl.[7] ..... B65D 43/16
(52) U.S. Cl. ..... 215/237; 220/796; 220/839
(58) Field of Search ..... 215/235, 45, 43, 215/321, 306, 796, 305, 317, 237; 220/210, 836, 837, 839, 375, 838, FOR 197, 4.22, 4.23, 796; 206/811

(56) References Cited

U.S. PATENT DOCUMENTS

| | | | | | |
|---|---|---|---|---|---|
| 2,711,840 | A | * | 6/1955 | Gits et al. | 215/DIG. 1 |
| 2,814,404 | A | | 11/1957 | Towns | |
| 2,814,405 | A | * | 11/1957 | Edwards | 215/253 |
| 2,852,054 | A | * | 9/1958 | Motley | 220/834 |
| 3,086,249 | A | * | 4/1963 | Nelson et al. | 264/513 |
| 3,252,492 | A | * | 5/1966 | Marchant | 215/235 |
| 3,282,477 | A | | 11/1966 | Henchert | |
| 3,362,556 | A | * | 1/1968 | Waldrum | 215/321 |
| 3,415,361 | A | * | 12/1968 | Adams, Jr. et al. | 206/221 |
| 3,416,688 | A | * | 12/1968 | Fanning | 215/306 |
| 3,419,179 | A | * | 12/1968 | Deuschle et al. | 220/375 |
| 3,470,930 | A | | 10/1969 | Jurczenia | |
| 3,592,349 | A | | 7/1971 | Baugh | |
| 3,786,982 | A | | 1/1974 | Rakes et al. | |
| 3,861,433 | A | * | 1/1975 | Schier et al. | 220/782 |
| 3,900,550 | A | | 8/1975 | Oliver et al. | |
| 4,082,201 | A | * | 4/1978 | Bittel | 215/306 |
| 4,180,178 | A | * | 12/1979 | Turner | 215/317 |
| 4,244,479 | A | * | 1/1981 | Smalley | 215/253 |
| 4,298,036 | A | * | 11/1981 | Horvath | 141/1 |

(List continued on next page.)

FOREIGN PATENT DOCUMENTS

WO PCT/US93/12490 12/1993

*Primary Examiner*—Lee Young
*Assistant Examiner*—Joseph C. Merek
(74) *Attorney, Agent, or Firm*—Greenberg Traurig LLP

(57) ABSTRACT

A leakproof, resealable container and cap assembly, consisting essentially of: a container having a rim at its upper portion and a cap having a circular base with an outer periphery, a cylindrical tubular skirt having an inner wall with at least one recess, a thumb tab for facilitating the opening and closing of the container, and a hinge connecting the cap to the container; and in a closed portion, the skirt of the cap overlies the container and the rim of the container is situated within the recess of the inner wall of the skirt of the cap.

9 Claims, 4 Drawing Sheets

U.S. PATENT DOCUMENTS 4,377,247 A 3/1983 Hazard et al.
4,386,714 A * 6/1983 Roberto et al. ..... 215/235
4,420,089 A * 12/1983 Walker et al. ..... 215/216
4,424,910 A * 1/1984 Heinol ..... 215/216
4,579,246 A * 4/1986 Swearingen et al. ..... 220/258
4,655,363 A 4/1987 Neat
4,713,219 A 12/1987 Gerken et al.
4,717,034 A 1/1988 Mumford
4,754,896 A * 7/1988 Roltgen et al. ..... 220/339
4,783,056 A 11/1988 Abrams
4,801,011 A * 1/1989 Desidoigts et al. ..... 206/389
4,807,425 A 2/1989 Abrams et al.
4,812,116 A 3/1989 Abrams
4,813,570 A 3/1989 Pontoppidan
4,866,952 A * 9/1989 Hight et al. ..... 206/37
5,000,204 A * 3/1991 Smith ..... 134/6
5,012,941 A 5/1991 Abrams et al.
5,020,683 A 6/1991 Strassheimer
5,108,029 A 4/1992 Abrams et al.
5,133,470 A 7/1992 Abrams et al.
5,139,165 A * 8/1992 Hara ..... 220/835
5,219,320 A 6/1993 Abrams et al.
5,269,430 A 12/1993 Schlaupitz et al.
5,429,699 A 7/1995 Abrams et al.
5,435,456 A * 7/1995 Dubach ..... 215/235
5,441,150 A 8/1995 Ma
5,474,177 A 12/1995 Abrams et al.
5,513,768 A 5/1996 Smith
5,575,399 A 11/1996 Intini
5,624,528 A 4/1997 Abrams et al.
5,638,957 A * 6/1997 Brasier ..... 206/581
5,667,094 A 9/1997 Rapchak et al.
5,723,085 A 3/1998 Abrams et al.
5,725,121 A * 3/1998 Gianpaolo ..... 220/375
6,050,400 A * 4/2000 Taskis et al. ..... 206/204

* cited by examiner

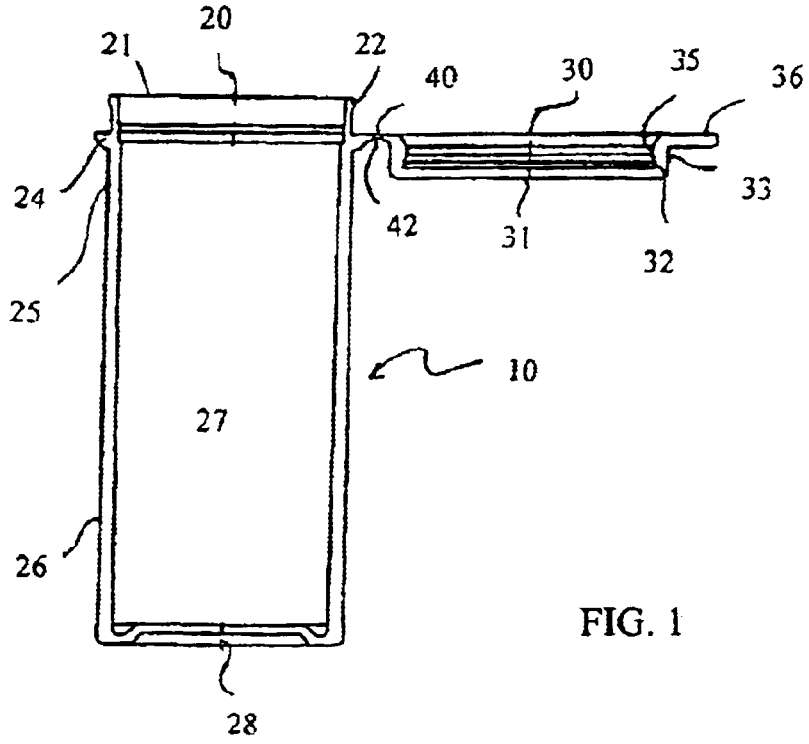
FIG. 1
FIG. 2
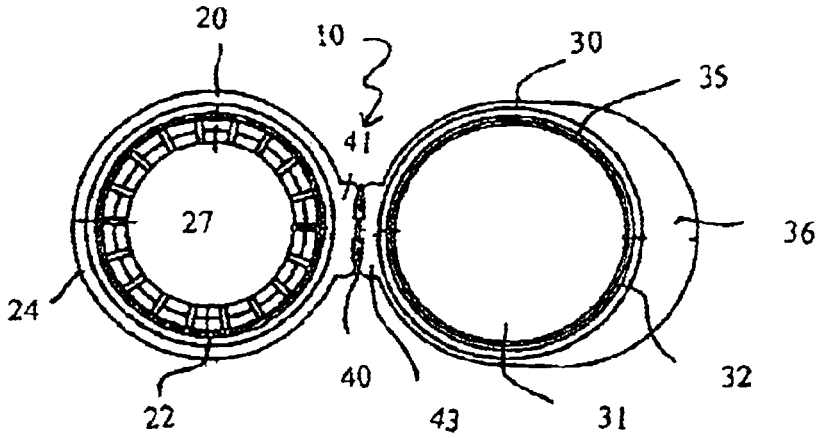

LEAKPROOF, RESEALABLE CONTAINER AND CAP ASSEMBLY

BACKGROUND OF THE INVENTION

It is desirable to provide a container that can be opened, sealed, or resealed using a frontal, singular motion and that can still produce a leakproof seal. For example, during laboratory applications such as drug testing, users of the containers desire the accessibility and resealability of the specimen by simply using frontal thumb pressure upon the thumb tab of the container to result in a leakproof container. In addition to ease to use, the integrity of the specimens in the containers is significant in ensuring proper chain of custody requirements of the container contents.

SUMMARY OF THE INVENTION

The present invention relates to a leakproof and resealable container and cap assembly. In one embodiment of the present invention, the assembly comprises a cap and container attached by a hinge. The container has an upper portion and an outer surface, and at the upper portion, the container has a rim. The cap has a circular base with an outer periphery and a cylindrical tubular skirt extending perpendicularly and outwardly around said outer periphery of the base; the skirt has an inner wall which includes at least one recess. In another embodiment, the cap has opposing ends; the cap has a thumb tab for facilitating the opening and closing of the container and the hinge attached to the container. The thumb tab and hinge are positioned on opposing ends of the cap and extend perpendicularly and outwardly from the skirt of the cap. In a further embodiment, the skirt of the cap overlies the container and the rim of the container is situated within the recess of the inner wall of the skirt of the cap during a closed position.

In yet another embodiment, the container further comprises a flange (i.e. an anti-decapping ring that serves to prevent the cap from being unintentionally opened and also serves as a visual scale to assure uniform cap position around the flange) projecting radially outwardly from the outer surface of the container. In still another embodiment, the hinge is attached to the container flange and the skirt of the cap is designed to overlie the rim of the container and be in uniform close proximity to the container flange during the closed position.

In a further embodiment, the cap and container assembly, in a closed position, forms an air tight seal.

In another embodiment, the cap and container are molded of plastic. In yet another embodiment, the cap and container are integrally molded of the plastic to form a hinge therebetween. In still another embodiment, the cap is fit to the container during the closed position to from a leakproof, air tight seal.

In a further embodiment, the hinge of the assembly has a recess. The recess forms two elements, the first element being attached to the skirt of the cap and the second element being attached to the container. In still a further embodiment, the recess functions as a bending point during the opening and closing of the container.

The present invention also relates to a method of manufacturing a leakproof resealable container and cap assembly, comprising: providing a container and cap connected by a hinge, the container has an upper portion and an outer surface, the container includes a rim at the upper portion; the cap has a circular base with an outer periphery and a cylindrical tubular skirt extending perpendicularly and outwardly around the outer periphery of the base, the skirt has an inner wall having at least one recess; the cap has opposing ends, the cap including a thumb tab; the tab and hinge is positioned on opposing ends of the cap and extend perpendicularly and outwardly from the skirt of the cap; and closing the container by applying, in a singular motion, a frontal, downward pressure upon the thumb tab to allow the skirt to overlie the container and the rim of the container to be situated within the recess of the inner wall of the skirt of the cap.

BRIEF DESCRIPTION OF THE DRAWINGS

A more complete appreciation of the present invention and many of the attendant advantages thereof will be readily understood by reference to the following description when considered in connection with the accompanying drawings in which:

FIG. 1 is a longitudinal sectional view of one embodiment through the leakproof, resealable container and cap assembly in accordance with the present invention;

FIG. 2 is an overhead plan view of one embodiment of the container and the cap connected by the hinge in an opened position;

Figure 3:
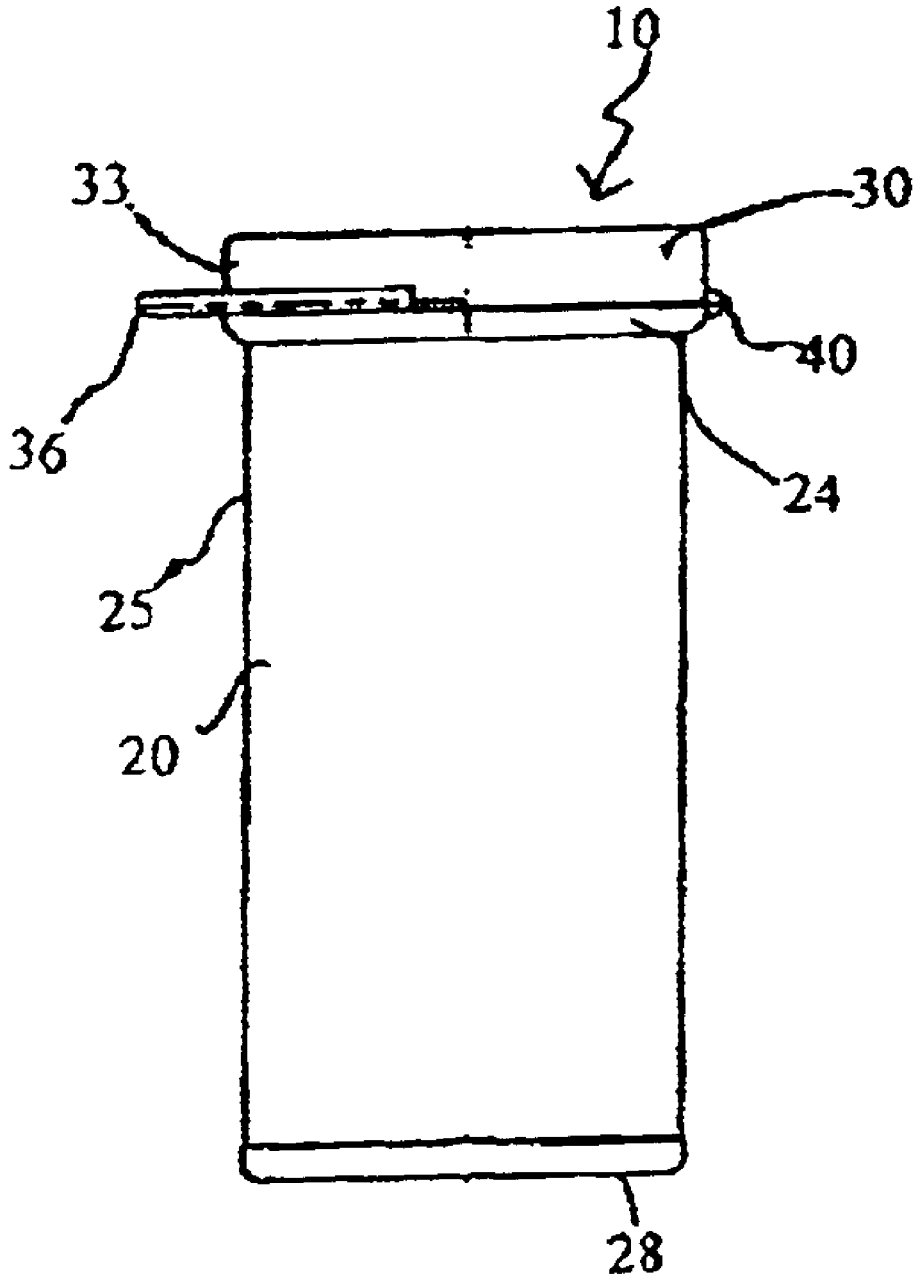
FIG. 3 is a side elevation view of one embodiment of the container and cap assembly of the present invention in a closed position.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE PRESENT INVENTION

The present invention relates to a leakproof and resealable container and cap assembly. The term "resealable" means that the container can be opened/reopened and closed/reclosed a numerous amount of times. The term "leakproof" means that the container passes the blue crystal dye test. The blue crystal dye test is a visual test to detect leaks within a container seal. A container "passes" the blue crystal dye test if the white paper, in which the container is placed on, does not visually change color (i.e. The white paper does not become contaminated with the blue crystal dye liquid from the container). The blue crystal dye test procedure consists of the following: (a) the blue crystal dye liquid is prepared by adding one teaspoon of blue crystal dye powder to one gallon of alcohol and the throughly mixing the solution; (b) the blue crystal dye liquid is poured into the container (i.e. a sufficient amount of the dye liquid must be added so, when the container is placed upside down, the entire seal area must be covered); (c) the container is closed by applying, in a singular motion, a frontal downward pressure upon the thumb tab (e.g. a user places his/her thumb parallel or on top of the thumb tab and applies a singular downward pressure) until the rim portion, adjacent to the thumb tab, contacts the inside flat part of the cap; (d) the container is placed upside down (i.e. inverted) on the white paper at room temperature; and (e) after 30 minutes, the white paper is inspected to determine if the white paper is contaminated with the blue crystal dye liquid.

In another embodiment, the cap and container assembly, in a closed position, forms an air tight seal. The term "air tight" means the moisture ingress of the container (after three days) was less than about 750 micrograms of water, preferably, about 250 micrograms of water, more preferably, about 150 micrograms of water determined by the following test method: (a) place one gram plus or minus 0.25 grams of molecular sieve in the container and record the weight; (b) the container is closed by applying, in a singular motion, a frontal downward pressure upon the thumb tab until the rim portion, adjacent to the thumb tab, contacts the inside flat part of the cap also adjacent to the thumb tab; (c) place the closed container in an environmental chamber at conditions of 80% relative humidity and 72° F.; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

Referring now to the drawings wherein like reference numerals designate identical or corresponding parts throughout the several views, and more particularly to FIG. 1 wherein one embodiment of the leakproof, resealable cap and container assembly 10 of the present invention is illustrated. The assembly 10 consist essentially of a container 20 having a base 28, an internal cavity 27, an outer surface 25, an upper 21 and lower 26 portion. The container 20 has a rim 22 at the upper portion 21. The assembly 10 also has a cap 30 which has a circular base 31 and a cylindrical tubular skirt 33 extending perpendicularly and outwardly around the outer periphery of the base 31. The cap 30 has opposing ends, at one end the cap 30 has a thumb tab 36 for facilitating the opening and closing of the container, and a hinge 40 attached to the container 20. The tab 36 and hinge 40 are positioned on opposing ends of the cap and extend perpendicularly and outwardly from the skirt 33 of the cap 30.

The container may also have a flange 24 projecting radially outwardly from the outer surface 25 of the container 20. The hinge 40 may also be attached to the container flange 24. The hinge 40 also has a recess 42 that functions as a bending point during the opening and closing of the container.

Suitable material for assembly 10 includes plastic (e.g. thermoplastics such as polypropylene and polyethylene). In one embodiment, the cap 30 and container 20 may be integrally molded of the plastic to form a hinge 40 therebetween. In one embodiment, the cap 30 and container 20 may be produced in a molding process and, in another embodiment, may be molded in accordance with the mold similar to that disclosed in U.S. Pat. Nos. 4,783,056 and 4,812,116, respectively. In a further embodiment, with such a process and mold, the assembly, including the cap, container and hinge may be produced in accordance with the operation disclosed in U.S. Pat. Nos. 4,783,056 and 4,812,116 or, in another embodiment, may be produced in accordance with U.S. Pat. No. 5,723,085. The disclosure of these patents are incorporated by reference herein.

In another embodiment, two step (i.e. thickened sections of the hinge) bridge the recess 42 on opposing ends of the recess. In yet a further embodiment, the first element of the hinge 40 is from about 0.03 inches to about 0.125 inches, preferably 0.06 inches, measured from the center-line of the recess and the outside perimeter of the cap. In still yet another embodiment, the second element of the hinge 40 is from about 0.1 inches to about 0.195 inches, preferably 0.125 inches, measured from the center-line of the recess to the outside perimeter of container.

In another embodiment, the thumb tab 36 (which is located in the frontal portion of the cap) is from about 0.125 inches to about 0.325 inches, preferably 0.235 inches, measured from the outside perimeter of the cap to the end of the tab. In still another embodiment, the assembly 10 can be sealed and/or resealed by applying, in a singular motion, a frontal, downward pressure upon the thumb tab to obtain a leakproof seal. As an example, a user places his/her thumb parallel

What is claimed is:

1. A method of using a leakproof resealable container and cap assembly, comprising the steps of:

gripping the container and cap assembly with one hand;

opening the container and cap assembly at the thumb tab, wherein: a) the cap is integrally attached to the container; b) the container having an upper portion and an inner and outer surface, the container having a cylindrical upstanding rim at the upper portion, the rim is defined as that portion of the container that contacts an inner wall of the cap, the rim having an inner and outer wall rim, whereby the inner rim wall is substantially parallel to the inner surface of the container; c) the cap having a circular base with an outer periphery and a cylindrical tubular skirt extending perpendicularly and outwardly around the outer periphery of the base, the skirt having an inner wall, the inner wall of the skirt comprising a first portion that is conically tapered, extends downward from a top portion of the skirt and is planar, a second portion connected to the first portion and that is substantially perpendicular to the base, extends downward from the first portion, and is planar, a third portion connected to the second portion and extends downward from the second portion, a fourth portion connected to the third portion and extends downward from the third portion, the inner wall having at least one cap recess formed by at least the third and fourth portions of the inner wall of the skirt, the cap having opposing ends, the cap including a thumb tab for facilitating the opening and closing of the container, d) the cap consisting of one hinge attached to the container wherein the hinge has at least one hinge recess bend point that functions to rotate the cap at one pivot point, the thumb tab and the hinge being positioned on substantially opposing ends of the cap and extending perpendicularly and outwardly from the skirt of the cap;

gripping the container and cap assembly with one hand;

applying a sufficient frontal, downward pressure upon the thumb tab of the cap with the one hand until the skirt of the cap overlies the container and at least a portion of the rim of the container engages the cap recess of the inner wall of the skirt of the cap so as to form a leakproof seal; wherein the leakproof seal is formed without the presence of an interlocking mechanism, whereby the interlocking mechanism consists of a projection, a gap and the annular skirt of the cap that combine to form a an annular channel for interlocking with the rim of the container, the annular channel is an annular gap formed between the annular projection and the inner wall of the skirt of the cap whereby the annular projection projects from an interior surface of the cap and is substantially perpendicular to the interior surface of the cap;

gripping the container and cap assembly with one hand;

opening the container and cap;

gripping the container and cap assembly with one hand;

again applying a sufficient frontal, downward pressure upon the thumb tab of the cap until the skirt of the cap overlies the container at least a portion of the rim of the container engages the cap recess of the inner wall of the skirt of the cap so as to form a leakproof seal.

2. The method of using a leakproof resealable container and cap assembly of claim 1 wherein a flange projects radially outwardly from the outer surface of the container.

3. The method of using a leakproof resealable container and cap assembly of claim 1 wherein the container and cap assembly are molded of plastic.

4. The method of using a leakproof resealable container and cap assembly of claim 3 wherein the hinge recess forms two elements, one element being attached to the skirt of said cap and the second element being attached to the container; the recess functions as a bending point during the opening and closing of the container.

5. The method of using a leakproof resealable container and cap assembly of claim 4 wherein the first element of the hinge is from about 0.03 inches to about 0.125 inches measured from a center line of the recess and an outside perimeter of the cap.

6. The method of using a leakproof rescalable container and cap assembly of claim 4 wherein the second element of the hinge is from about 0.1 inches to about 0.195 inches measured from a center line of the recess to an outside perimeter of the container.

7. A method of using an air-tight resealable container and cap assembly, comprising the steps of:

gripping the container and cap assembly with one hand;

opening the container and cap assembly at the thumb tab, wherein: a) the cap is integrally attached to the container; b) the container having an upper portion and an inner and outer surface, the container having a cylindrical upstanding rim at the upper portion, the rim is defined as that portion of the container that contacts an inner wall of the cap, the rim having an inner and outer wall rim, whereby the inner rim wall is substantially parallel to the inner surface of the container; c) the cap having a circular base with an outer periphery and a cylindrical tubular skirt extending perpendicularly and outwardly around the outer periphery of the base, the skirt having an inner wall, the inner wall of the skirt comprising a first portion that is conically tapered, extends downward from a top portion of the skirt and is planar, a second portion connected to the first portion and that is substantially perpendicular to the base, extends downward from the first portion, and is planar, a third portion connected to the second portion and extends downward from the second portion, a fourth portion connected to the third portion and extends downward from the third portion, the inner wall having at least one cap recess formed by at least the third and fourth portions of the inner wall of the skirt, the cap having opposing ends, the cap including a thumb tab for facilitating the opening and closing of the container, d) the cap consisting of one hinge attached to the container wherein the hinge has at least one hinge recess bend point that functions to rotate the cap at one pivot point, the thumb tab and the hinge being positioned on substantially opposing ends of the cap and extending perpendicularly and outwardly from the skirt of the cap;

gripping the container and cap assembly with one hand;

applying a sufficient frontal, downward pressure upon the thumb tab of the cap with the one hand until the skirt of the cap overlies the container and at least a portion of the rim of the container engages the cap recess of the inner wall of the skirt of the cap so as to form an airtight seal; wherein the airtight seal is formed without the presence of an interlocking mechanism, whereby the interlocking mechanism consists of a projection, a gap and the annular skirt of the cap that combine to form a an annular channel for interlocking with the rim of the container, the annular channel is an annular gap formed between the annular projection and the inner wall of the skirt of the cap whereby the annular projection projects from an interior surface of the cap and is substantially perpendicular to the interior surface of the cap;

gripping the container and cap assembly with one hand;

opening the container and cap;

gripping the container and cap assembly with one hand;

again applying a sufficient frontal, downward pressure upon the thumb tab of the cap until the skirt of the cap overlies the container and at least a portion of the rim of the container engages the cap recess of the inner wall of the skirt of the cap so as to form an airtight seal.

8. The method of using an air-tight resealable container and cap assembly of claim 7 wherein the recess of the hinge forms two elements, one element being attached to the skin and the second element being attached to the container, the first element of the hinge is from about 0.03 inches to about 0.125 inches, measured from a center line of the recess and an outside perimeter of the cap; and wherein the recess of the inner wall of said cap has angular plane surfaces of about 15 to about 35 degrees from a reference vertical.

9. The method of using an air-tight resealable container and cap assembly of claim 7, wherein the airtight ability of the assembly in the closed position is less than about 150 micrograms of water after three days.

* * * * *

UNITED STATES PATENT AND TRADEMARK OFFICE

CERTIFICATE OF CORRECTION

PATENT NO. : 6,769,558 B1
APPLICATION NO. : 09/386702
DATED : August 3, 2004
INVENTOR(S) : Michael Bucholtz It is certified that error appears in the above-identified patent and that said Letters Patent is hereby corrected as shown below:

In the Specification

Col. 4, Ln. 16, after the word "parallel" insert:

--or on top of the thumb tab (i.e. the frontal portion of the container) and applies a singular downward pressure until an audible snap is heard and then verified by visual inspection of uniform cap position around the flange.

FIG. 2 refers to an overhead plan view of the assembly 10 to the present invention in an opened position. The assembly 10 includes the container 20 and the cap 30 connected by the hinge 40. The container 20 has the cavity 27, the rim 22, and the flange 24. The cap includes the circular base 31, the inner wall 35 with the recess 32, and the thumb tab 36. The hinge 40 has two elements, 41 and 43, respectively, formed by the recess. One element 41 is attached to the flange 24 of the container 20 and the second element 43 is attached to the cap 30.

FIG. 3 depicts a side elevation view of the present invention in a closed position. The cap and container assembly 10 comprises the cap 30 and the container 20 connected by the hinge 40. The container 20 has a flange 24 extending from the outer surface 25 and a base 28. The cap 30 has a cylindrical skirt 33 and the thumb tab 36 extending perpendicularly outwardly from the skirt 33. In a closed position, the skirt 33 of the cap 30 overlies the container 20 and lies upon the flange 24 of the container 20.

Figure 4:
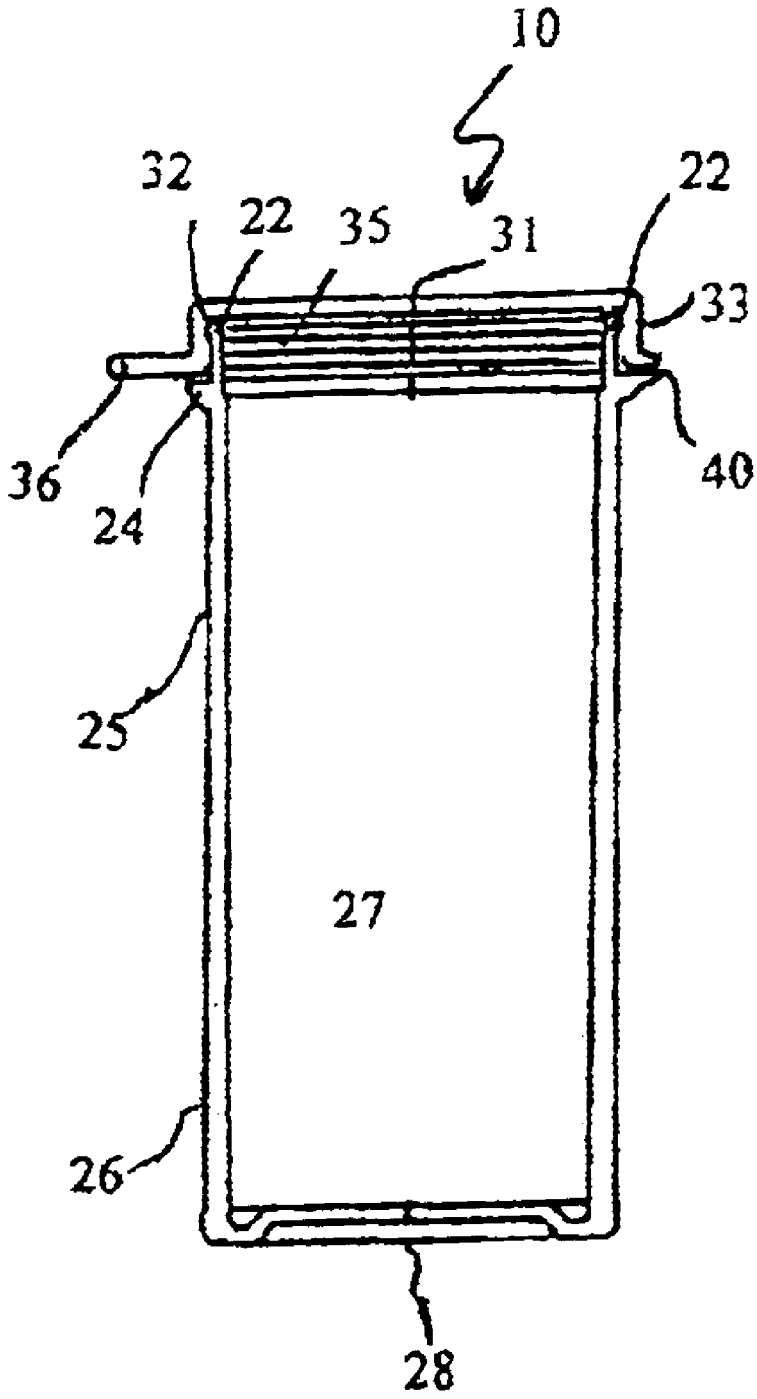
FIG. 4 is a cross-sectional side view of one embodiment of the assembly in a closed position.

FIG. 4 illustrates a cross-section view of the assembly 10 in a closed position. The skirt 33 of the cap 30 overlies the container 20 and lies upon the flange 24 of the container 30 while the rim 22 of the container 20 is situated within the recess 32 of the inner wall 35 of the skirt 33 of the cap 30. The container 20 can be sealed and/or resealed by applying, in a singular motion, frontal, downward pressure upon the thumb tab 36 to obtain a leak proof seal and/or an air tight seal.

Figure 5:
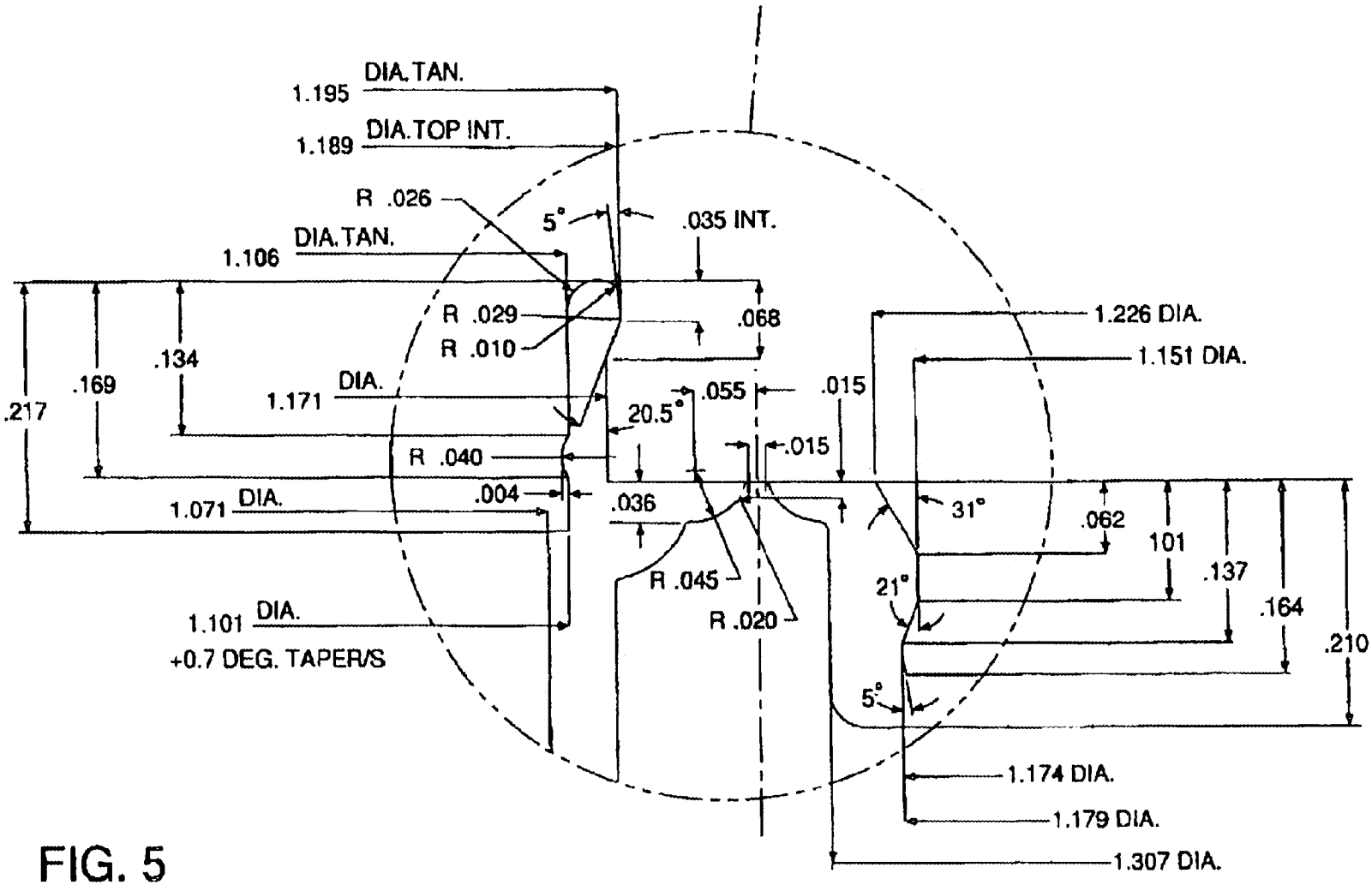
FIG. 5 is a detailed blow-up showing a portion of the cap and container of one embodiment of the container and cap assembly of the present invention with measurements and angles.

FIG. 5 illustrates a cross-section view of one embodiment of the cap and container assembly Signed and Sealed this
Sixteenth Day of September, 2014

Michelle K. Lee

Michelle K. Lee
*Deputy Director of the United States Patent and Trademark Office* of the present invention made of polypropylene with measurements and angles detailed in Figure 5. In this embodiment, the rim 22 has an inner wall rim 22a and an outer wall rim 22b and has one engagement surface 22c, which has about a 20 degree vertical inclination for locking engagement against the corresponding surface of the cap. The rim 22 also has a rounded edge, which has about a 5 degree vertical inclination, for ease of closing. The inner wall of the skirt 33 of the cap 30 has a recess 32 having a first angular plane surface 32a of about 5 degrees from the reference vertical, a second angular plane surface 32b of about 21 degrees from a reference vertical, and a third angular plane surface 32c of about 31 degrees from a reference vertical. In another embodiment, the recess 32 has two angular plane surfaces - - (i.e. the 5 degree angular plane surface of Figure 5 is eliminated).

Numerous modifications and variations of the present invention are possible in light of the above teachings. It is therefore to be understood that within the scope of the attendant claims attached hereto, this invention may be practiced otherwise than are specifically disclosed herein--